US005309830A

United States Patent [19]

Vermesse

[11] Patent Number: 5,309,830

[45] Date of Patent: May 10, 1994

[54] ROTARY PRINT DRUM FOR A POSTAGE METER INCLUDING REVOLVING ELECTRONIC CIRCUITS

[75] Inventor: Bernard Vermesse, L'Hay Les Roses, France

[73] Assignee: Societe Anonyme Dite: Neopost Industrie, Bagneux, France

[21] Appl. No.: 991,538

[22] Filed: Dec. 15, 1992

[30] Foreign Application Priority Data

Dec. 17, 1991 [FR] France ..... 9115665

[51] Int. Cl.[5] ..... B41J 29/00

[52] U.S. Cl. ..... 101/91; 235/101

[58] Field of Search ..... 101/91, 110, 45, 92, 101/85, 99, 86, 87, 79; 235/101

[56] References Cited

U.S. PATENT DOCUMENTS

| | | | |
|---|---|---|---|
| 4,398,458 | 8/1983 | Denzin et al. | 101/91 |
| 4,702,164 | 10/1987 | Muller | 101/91 |
| 4,724,759 | 2/1988 | Gilham et al. | 101/91 |
| 4,774,881 | 10/1988 | Schubert | 101/91 |

FOREIGN PATENT DOCUMENTS

| | | |
|---|---|---|
| 0239356 | 9/1987 | European Pat. Off. . |
| 2335002 | 7/1977 | France . |
| 2624966 | 6/1989 | France . |
| 9016047 | 12/1990 | PCT Int'l Appl. . |
| 2194842 | 3/1988 | United Kingdom . |

*Primary Examiner*—Edgar S. Burr
*Assistant Examiner*—Ren Yan
*Attorney, Agent, or Firm*—Sughrue, Mion, Zinn, Macpeak & Seas

[57] ABSTRACT

A rotary print drum in combination with a postage meter comprises at least one print wheel rotatably mounted on the print drum, a motor and a gear train for rotating the print wheel, an electronic circuit in a form of a printed circuit being fixed to one end of the drum in a plane perpendicular to the rotational axis of the print drum, and detecting device operatively connecting the gear train and the electronic circuit for controlling the print position of the print wheel.

2 Claims, 2 Drawing Sheets

ROTARY PRINT DRUM FOR A POSTAGE METER INCLUDING REVOLVING ELECTRONIC CIRCUITS

FIELD OF THE INVENTION

The present invention relates to a postage meter having a rotary print drum.

BACKGROUND OF THE INVENTION

Postage meters that include rotary print drums for printing fixed and variable postage data on mail are already know. Particular mention may be made to French Patent Applications FR-A-89 16250 and FR-A-90 08752 filed in the name of the applicant.

For this type of meter, maximum overall postage meter compactness is sought, together with simplified electromechancial coupling between the various members making up the print head in the meter.

To facilitate understanding the problems posed by this type of meter, a prior art postage meter is described below with reference too FIGS. 1 and 2.

FIG. 1 shows an example of a print head 10. This print head 10 includes a print roller 12 secured to the end 14 of a shaft which can be mechanically coupled to a rotary drive device 16 in the meter. Inside the drum 12 there are print wheels 18 which have print elements 20 on their peripheries, which print elements correspond, for example, to all ten digits The print wheel 18 can rotate about its axis, as indicated by arrow F. Naturally, the drum includes as many wheels as there are graphical elements to be printed. The print wheel 18 is secured to a toothed wheel 22 so that it rotates therewith, which toothed wheel can be rotated by engagement with a rack 24 mounted at the end of a drive rod 26 which is in turn slidably mounted in the shaft 14 which is hollow. Each rod 26 associated with a wheel 18 is secured to a respective sliding ring 28 so that it moves in translation therewith. The ring 28 being displaced in translation enables the corresponding rack 24 to be controlled, whereby the print wheel 18 can be rotated to bring the suitable print element 20 to face a print window provided in the drum 12 and not shown in the FIGURE. The ring 28 may be displaced in translation by a slider 30 which co-operates with the ring 28 to move it in translation, but which leaves the ring free to rotate. A double rack 32 secured to the slider 30 co-operates with a toothed wheel 34 in turn secured to a knurled control wheel 36 for controlling the position of the print wheel 18. Adjusting the position of the control wheel 36 sets the position of the corresponding print element 20 so that it faces the print window. The other end of the double rack 32 makes it possible to rotate the wheel 38 of a position encoder bearing the overall reference 40. FIG. 1 also shows a printed circuit card 42 carrying the various electronic circuit components of the print head 10.

FIG. 2 is a plan view of the various rod-and-rack assemblies 24, 26 that are each associated with a respective position-control sliding ring 28.

The purpose of the position encoder 38 is to make sure that the position of the print wheel 18 actually does correspond to the position displayed by the control wheel 36.

Prior art print heads suffer from being bulky and complex due to the mechanical linkages between the control wheel 36, the position sensor 38, and the print wheel 18. These problems are proportional to the number of print wheels 18 required to print the values, dates, and other data, e.g. eleven wheels.

In prior embodiments, one rack is used for each print wheel. Each rack performs the following three functions:

A first end of the rack co-operates with the print wheel to define the digit or the symbol to be printed. A second end of the rack serves to position the rack, and therefore the corresponding print wheel, by means of a motor which receives instructions in electrical form. A middle portion co-operates with the position encoder to read back the effective position of the rack, and therefore of the print wheel.

The use of racks suffers from two types of drawback.

Firstly, the rack can only have reciprocating motion and cannot have continuous motion. As a result, if it is necessary to print a zero with a wheel, after that wheel has printed a 9, the associated rack must be displaced over its full stroke. This significantly increases the basic print time required to print one digit.

Secondly, since the position encoder is disposed along the rack, the revolving electronic circuitry must be disposed parallel to the shaft 14. If the quantity of electronic components increases, that length of the shaft 14 which serves only to support the printed circuit also increases. This leads to an increase in the overall length of the shaft.

An object of the present invention is to provide a postage meter having a rotary print drum that does not suffer from these problems, and that offers maximum integration of the print head.

SUMMARY OF THE INVENTION

To this end, according to the invention, the postage meter includes a rotary print drum, positioning means for positioning and locking print wheels mounted in said drum, means for picking up the respective effective positions of said wheels, drive means for driving the positioning means, means for rotating the head, and electronic circuitry for controlling the drive means, for processing the effective position data, and for counting the postage printing operations performed. The meter is characterized in that at least the means for picking up data giving the effective positions of the print wheels, and at least a portion of said electronic circuitry are secured to the rotary print drum, and in that the meter further includes electrical coupling means for connecting the portion of the electronic circuitry that is secured to the drum to another portion of the electronic circuitry that is fixed, and in that the positioning means for positioning and locking the print wheels 18 comprise a first gear train 110 drivingly connecting said print wheel 18 to drive motor means 56, and in that the means for picking up the respective effective positions of each print wheel comprise a second gear system connecting said print wheel to an encoder wheel 116 cooperating with means 118 for encoding the angular position of said encoder wheel.

It can be understood that, in this way, it is possible to increase the number of components that are mounted directly on the rotary print drum, thereby increasing the integration of the meter and reducing the problems of coupling between the fixed portion and the removable portion, in particular due to the fact that the effective position readers are integral parts of the rotary drum, as are the electronic circuits for processing the encoder signals.

Other characteristics and advantages of the present invention will appear more clearly on reading the following description of a preferred embodiment of the invention given with reference to the accompanying drawings, in which:

DESCRIPTION OF THE PREFERRED EMBODIMENT

Figure 1:
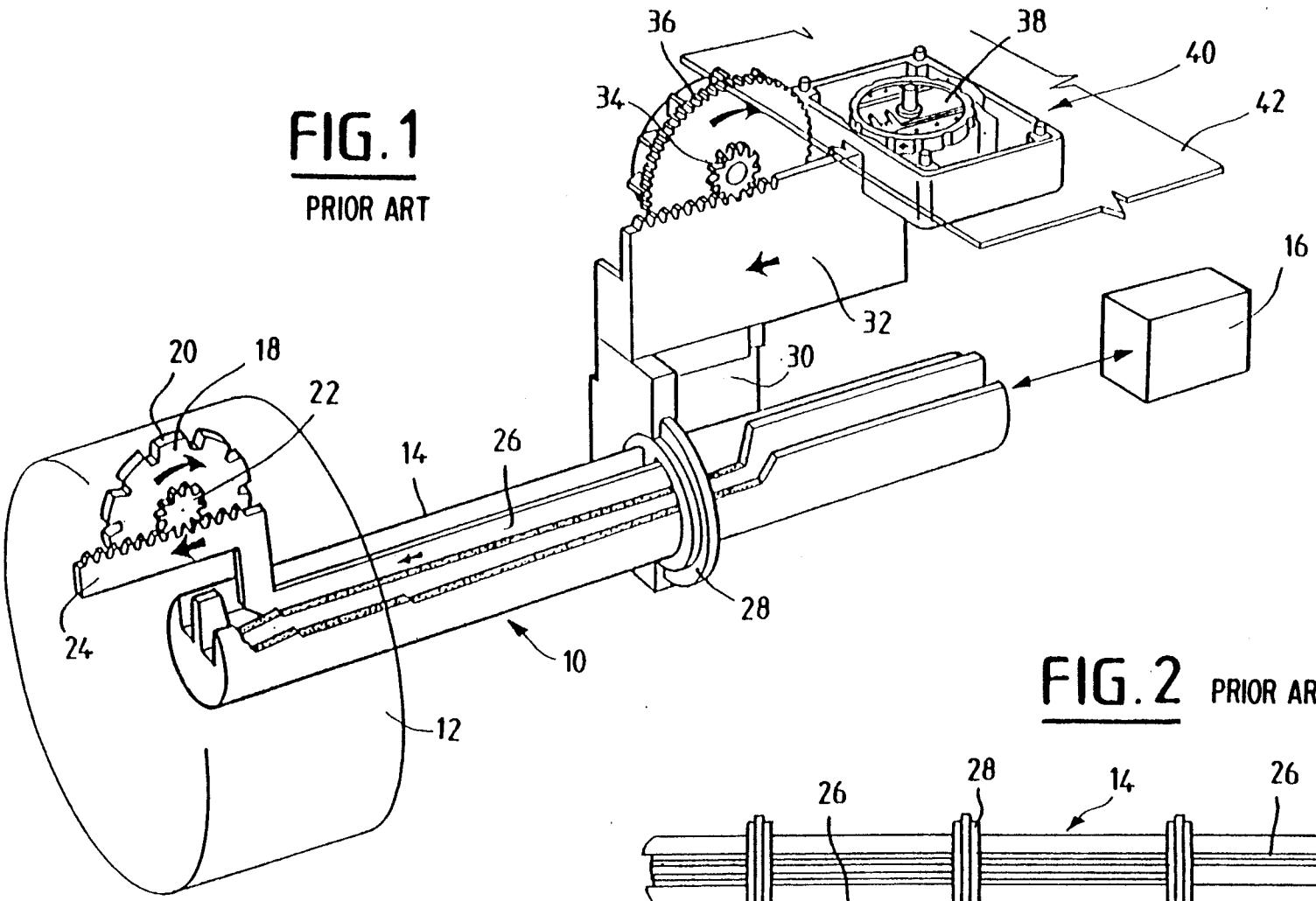
FIG. 1 PRIOR ART
FIG. 1, which is described above, is a partially cutaway perspective view of an embodiment of a prior art postage meter having a removable print head.
Figure 2:
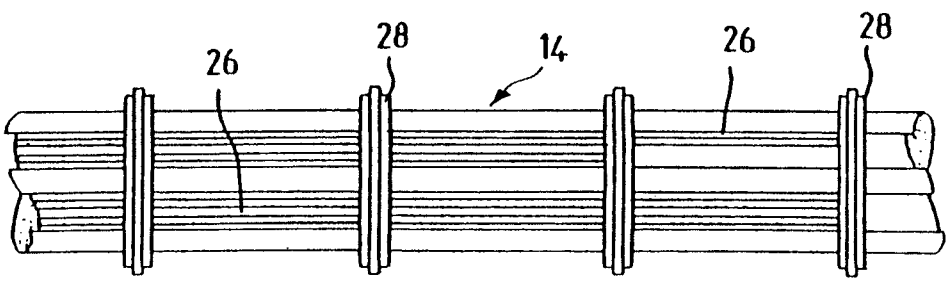
FIG. 2 PRIOR ART
FIG. 2 is a plan view of a portion of the FIG. 1 removable head.
Figure 3:
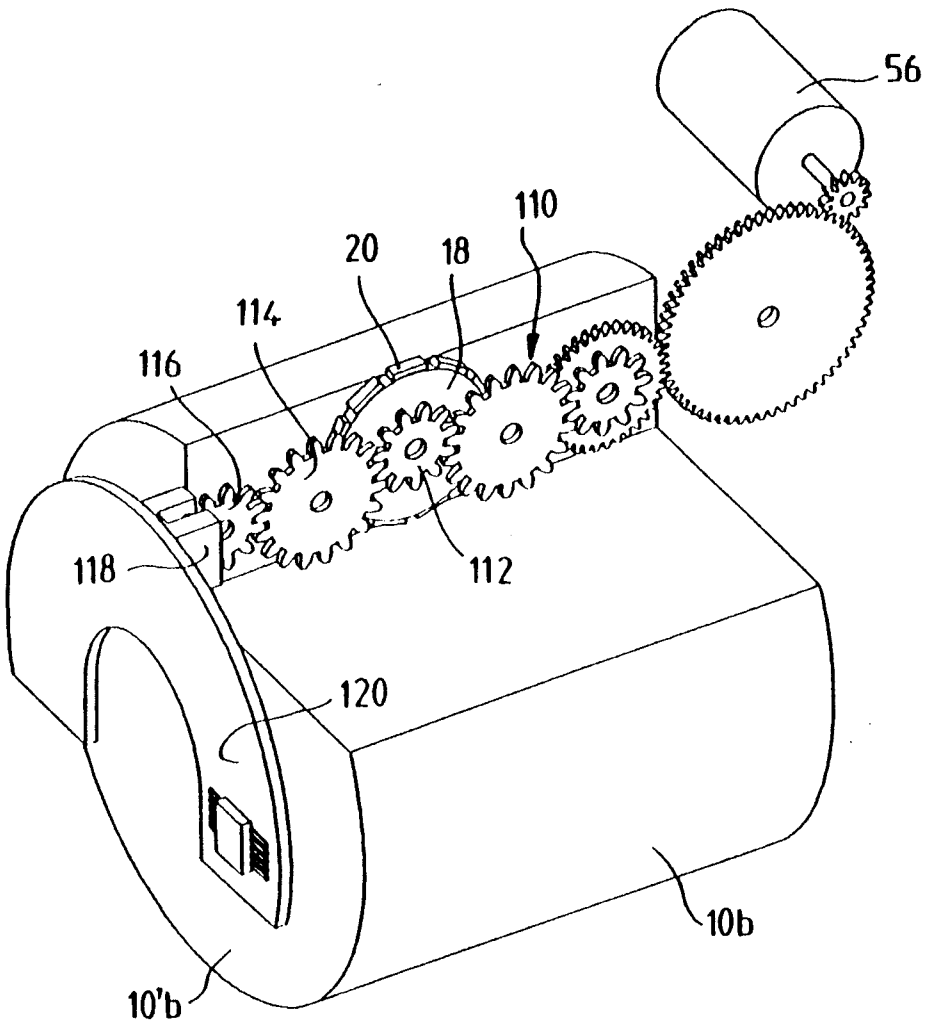
FIG. 3 is a perspective view of a preferred embodiment of the invention.

FIG. 3 shows a preferred embodiment of the print head. The print head 10*b* is still mounted at the end of a rotary drive shaft (not shown in FIG. 3), but the racks have been eliminated. The print wheel 18, together with its print elements 20, is in a middle position. The print wheel is connected to the motor 56 for controlling the position of the print wheel via a gear train 110 which engages with the toothed wheel 112 secured to the print wheel 18. The motor 56 is preferably secured to a rocker shaft so as to be retractable to enable the print head to be engaged. A toothed transmission wheel 114 connects the toothed wheel 112 to a position encoder wheel 116. The position of the encoder wheel 116 is identified by an opto-electronic system 118 in the form of a fork which, on respective sides of the wheel, and includes a light emitter and a detector.

In this embodiment, the printed circuit 120 is fixed to the end 10'*b* of the print drum 10*b*. For example, it is U-shaped with its main plane perpendicular to the axis of rotation of the head. As shown in FIG. 3, the position sensor 118 is fixed directly to one of the faces of the printed circuit 120, thereby reducing the length of the conductive tracks.

In the same way, the motor 56 is preferably connected to the conductive tracks of the printed circuit.

This embodiment operates as follows: with the assembly being at rest, the motor 56 is controlled so as to place the print wheel 18 at the desired value. During this step, the system 118 is used in co-operation with the encoder wheel 116 to check the accuracy of the positioning. The positioning means constituted by the motor 56 are then disengaged from the gear train 110. To print the value, the assembly is rotated. During the rotation, and while the digit defined by the print wheel 18 is being printed, the position of the wheel is read by means of the system 118 identifying the position of wheel 116. The components of the electronic circuit 120 perform a first processing step during which they process the signals supplied by the system. Naturally, electrical or electronic coupling means (not shown in FIG. 3) must exist between the base of the meter and the removable head, and between the fixed portion and the moving portion of the print head.

I claim:

1. A rotary print drum in combination with a postage meter, comprising:

a first end for connection to a driven shaft, a second end opposite to said first end, and a rotation axis extending through said first and second ends;

at least one print wheel rotatably mounted on said drum and having an outside generally cylindrical surface with a plurality of characters in discreet positions on said outside surface;

motor means, a gear train drivingly connecting said motor means to said print wheel to rotate said print wheel into a print position;

electronic circuit means for controlling said motor means for causing rotation of said print wheel, said electronic circuit means being disposed on a printed circuit fixed to the second end of the drum and being disposed in a plane perpendicular to the print drum rotation axis; and detecting means operatively coupled to said gear train and operatively connected to said electronic circuit means for informing said electronic circuit means of the print position of said print wheel.

2. The rotary print drum according to claim 1 wherein said detecting means comprises;

an opto-electronic system fixably mounted to said printed circuit, a position encoding wheel mounted to said print drum for rotation about an axis and being in mesh with said gear train, and wherein said opto-electronic system includes a fork within which is positioned said position encoding wheel.

* * * * *